US005313859A

United States Patent [19]

Garby et al.

[11] Patent Number: 5,313,859

[45] Date of Patent: May 24, 1994

[54] REMOVER FOR CHILD RESISTANT CLOSURE

[75] Inventors: Gage Garby; Jeffery T. Ballas, both of Boulder, Colo.

[73] Assignee: Senetics, Inc., Boulder, Colo.

[21] Appl. No.: 38,578

[22] Filed: Mar. 26, 1993

[51] Int. Cl.[5] ..... B67B 7/44

[52] U.S. Cl. ..... 81/3.55; 81/3.09; 7/156; 30/1.5

[58] Field of Search ..... 81/3.07, 3.4, 3.55, 81/3.57, 3.09; 30/1.5; 7/151, 156

[56] References Cited

U.S. PATENT DOCUMENTS

| | | | |
|---|---|---|---|
| 2,070,212 | 2/1937 | Minden | 81/3.55 |
| 2,276,476 | 3/1942 | Folger | 30/1.5 |
| 2,291,866 | 8/1942 | Bethke | 81/3.55 |
| 2,694,854 | 11/1954 | Kannenberg | 30/1.5 |
| 3,885,478 | 5/1975 | Evans | 81/3.55 |
| 4,770,069 | 9/1988 | Mikan et al. | 81/3.55 |

FOREIGN PATENT DOCUMENTS 2911086 10/1979 Fed. Rep. of Germany ..... 81/3.55

*Primary Examiner*—Roscoe V. Parker

*Attorney, Agent, or Firm*—Beaton & Swanson

[57] ABSTRACT

A device for removing a child resistant closure from a container, including a tab to receive the protrusion of a closure of the line-up-the-arrows type, a recess to receive the closure adjacent the tab, an inclined side of the recess to bear against the closure and maintain the tab in engagement with the protrusion, and an end of the device opposite the tab to receive a force. The recess is such that it can accept varying sizes of closures. Applying a force to the forcereceiving end in the downward direction levers the tab upward to pry the closure off the container. The tab is positioned on the device in such a way that the user can readily see the engagement of the tab with the closure protrusion.

16 Claims, 1 Drawing Sheet

REMOVER FOR CHILD RESISTANT CLOSURE

FIELD OF THE INVENTION

The present invention relates to the field of child resistant closures and, in particular, a device for removing a child resistant closure from a container. The device is particularly useful in child resistant closures of the "line-up-the-arrows" type.

BACKGROUND OF THE INVENTION

Medicine tablets and capsules are typically packaged in vials or small bottles having a closure which is resistant to removal by a child. In this way, the medicine is readily available for administration to the patient, but cannot easily be accessed by children. These child resistant closures are mandated by law in the United States and many other countries for medicine which could be poisonous to children.

Child resistant closures can be grouped into two categories. One category of child resistant closures includes closures that require the simultaneous application of a force urging the closure toward the container and a rotative force, which are sometimes called "push and turn" closures. A force urging the closure toward the container engages a set of tabs on one part of the closure with a set of notches on another part of the closure, so that a rotative force applied to the first part of the closure is translated into a rotative force on the second part of a closure in order to unthread the second part of the closure from the threaded neck of the bottle. In another embodiment of the push and turn type child resistant closures, the neck of the container holds a set of bayonet lugs which mate with a mating set of bayonet lugs on the inside of an axial skirt of the closure. A force urging the closure toward the container is necessary to disengage the bayonet lugs from the mating lugs, and then a rotative force is necessary to position the mating lugs in the spaces between the bayonet lugs to allow removal of the closure.

The second category of child resistant closures employ a radially outward protruding bead on the neck of the container and one or more radially inward protruding mating beads on the axial skirt of the closure. The bead on the closure snaps over the bead on the neck of the container. The bead on the neck of the container is interrupted, such that there is no bead on a short circumferential portion of the neck. The axial skirt of the closure includes a radially inward extending protrusion having a circumferential length that allows it to pass through the interruption in the bead of the container neck. Therefore, the closure can be removed from the container only when the closure and container are angularly aligned such that the closure protrusion matches the container neck bead interruption so that the closure bead can be snapped off from the container neck bead. If there is no such alignment, the closure protrusion is retained beneath the container neck bead and so the closure cannot be removed. The container neck bead is typically tapered on the upper side, so that the closure protrusion will snap over the container neck bead to replace the closure on to the container even without aligning the closure protrusion with the container neck bead interruption.

Finally, there is normal]y a symbol on the outer surface of the closure and on the outer surface of the container neck to indicate the location of the closure protrusion and container neck bead interruption, respectively, so that the user can ascertain the alignment of those elements. The marker on the closure is usually a protruding arrow to assist the user in applying a force urging the closure away from the container once the proper alignment is achieved to accomplish removal of the closure from the container. Even when the markers are lined up so that the closure protrusion aligns with the container neck bead interruption, it is still necessary to apply a fairly significant force urging the closure away from the container to snap the closure bead past the container bead to open the container. It is this second category of child resistant closures—the so-called line-up-thearrows type—with which the present invention is primarily concerned.

A drawback to these line-up-the-arrow type child resistant closures is that it not only resists opening by a child but also resists opening by an adult. The significant force urging the closure away from the container once the arrows are lined up is very difficult for a person with a muscular or joint disorder or injury, such as arthritis, or for people who are elderly or infirm. Such persons may suffer pain when applying that force, or may be simply unable to apply the requisite force at all regardless of how much pain they are willing to suffer. The result is that either the medicine does not get taken, the patient must obtain help in taking the medicine, or the patient simply defeats the child resistant aspects of the closure by keeping the closure unfastened from the container.

There are several devices in the prior art to assist in the removal of line-up-the-arrow closures from a container. For example, U.S. Pat. No. 4,770,069 by Mikan, et al. discloses an opener having a plate with a projecting ring slightly larger than the cap. The ring has an opening to receive the projecting marker on the cap. The plate acts as a lever so that applying a force urging the plate toward the container at the plate edge opposite the opening in the ring pries the cap away from the closure. A significant limitation to the device of Mikan is that it is limited to use with a single cap size. Also directed toward the removal of child resistant closures from medicine vials and the like is U.S. Pat. No. 3,885,478 by Evans. The Evans device is somewhat limited in that it grasps one side of the closure but not the other side of the closure, and so the grasping end of the device tends to slip away from the center of the closure and off the closure end that is grasped.

The prior art includes other devices designed less specifically toward the removal of child resistant closures and more generally toward the removal of ordinary bottle caps. Such devices include devices disclosed in U.S. Pat. No. 4,433,597 by Rowland, 4,455,894 by Roberts, 4,178,646, two by Swartz, et al., 4,514,565 by Capriccio, 2,440,485 by Ranseen, and 2,568,612 by Cullen.

DESCRIPTION OF THE INVENTION

The present invention overcomes the limitations of the prior art by including a simple and inexpensive tool which securely fits onto the cap of a line-up-thearrow type child resistant closure. The design of the device allows a single device to be used for closures of varying sizes with no reduction in the effectiveness of the device or the security of the engagement of the device with the enclosure. The closure-engaging portion of the device includes a window for the user to confirm that it is properly engaged with the protrusion on the closure before attempting to operate the device.

The device may also include a point to use as a tool in cutting away the cellophane or paper seal which acts as a tamper-evident means on many closures and to puncture and tear away the foil seal on the container under the cap when it is first opened. On the opposite end of the device, or elsewhere on the device, may be a hook for the purpose of hooking and removing cotton packing stuffed into the container when it is first opened. A hole through the device allows it to easily be placed on a key chain or elsewhere for safe keeping.

DETAILED DESCRIPTION OF INVENTION

Figure 1:
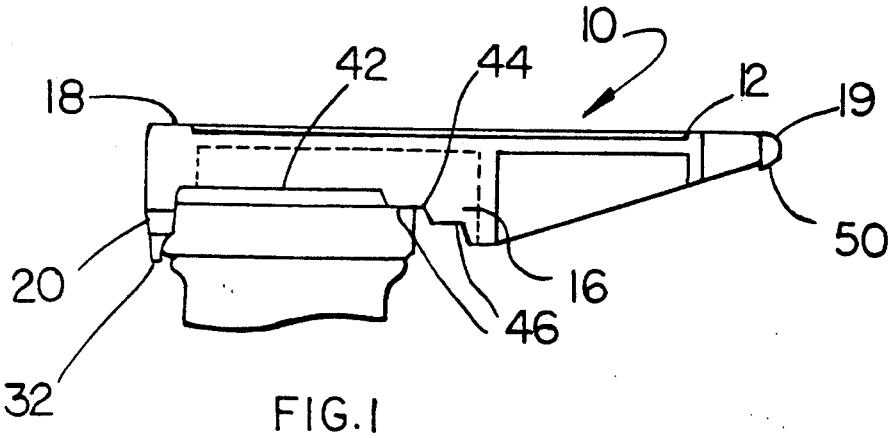
FIG. 1 shows an elevation view of the present invention engaged with a closure on the neck of a container.
Figure 2:
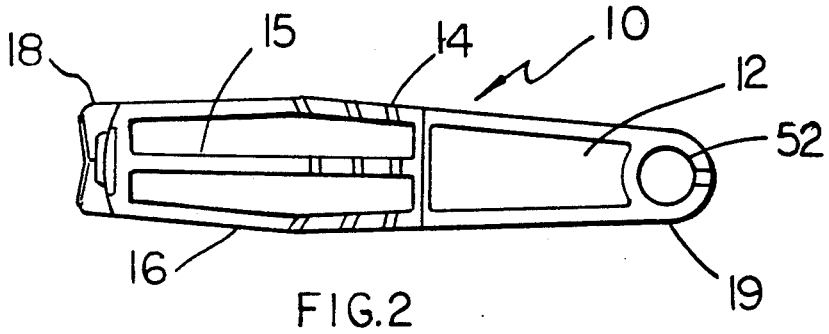
FIG. 2 shows a bottom view of the invention.
Figure 3:
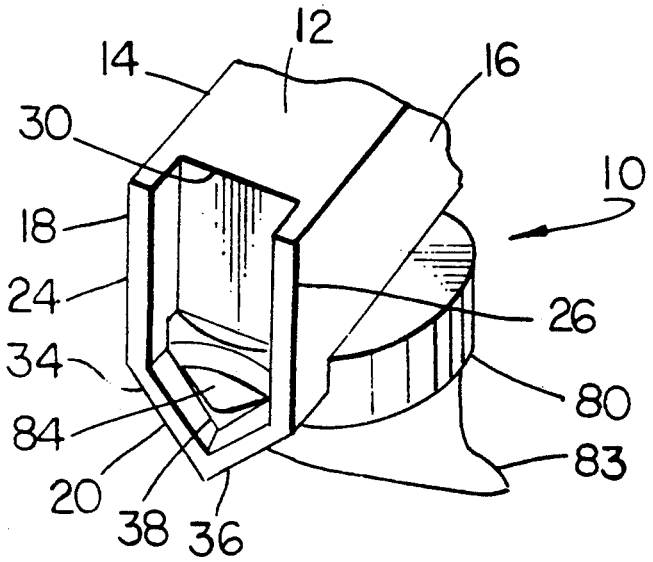
FIG. 3 shows a perspective view of the invention engaged with a closure.

As shown in FIGS. 1 and 2, the invention 10 is generally an elongated member having a top 12 and two sides 14 and 16. At one end 18 of the device is a downwardly extending tab 20, which is best shown in FIGS. 1 and 3.

The tab 20 is v-shaped and is attached to the device 10 by a pair of side supports 24 and 26. The side supports 24 and 26 extend from the tab 20 upwardly on either side of the v-shaped tab 20 to meet the sides 14 and 16 and top 12 of the device 10. Between the two side supports 24 and 26 is a cutout 30. Thus the combination of the v-shaped tab 20 and the two side supports 24 and 26 are mounted to the end 18 of the device 10.

The v-shaped tab 20 includes a point 32 at its tip having the function described below. The two sides 34 and 36 of the tab 20 are preferably tapered so that they are wider (in the longitudinal direction of the device) at the top than at the bottom. Tapered edge 38 of the tab 20 engages the protrusion of the closure in the manner described below.

The sides 14 and 16 have cutouts to define a recess that receives the closure as shown best in FIG. 1. The cutouts include a substantially flat portion 42 at the top of the cutout and a generally inclined portion 44 which inclines from the cutout top 42 to the end of the cutout. As shown in FIG. 1, the generally inclined portion 44 may include a series of steps 46. Each step 46 includes a flat portion and an inclined portion connecting the step to the next step. The end 19 of the device 10 which is opposite the end 18 that engages the closure may include a hook 50. That same end 19 may include a hole 52 therethrough. As shown in the bottom view of FIG. 2, there may also be a center for support between the two sides 14 and 16 to provide additional resistance to the bending of the device.

In operation, the end 18 is positioned over the edge of a closure 80 which is attached to a container 82 in the manner shown in FIGS. 1 and 3 so that the closure 80 is received by the recess defined by sides 14 and center support member 15. The v-shaped tab 20 is hooked under the protrusion 84 of the closure 80 so that the edge 38 of the tab 20 is engaged by the inclined sides of the protrusion 84. At the opposite end of the recess in the device 10 from the tab 20, the inclined portion 44 of the cutout rests on the edge of the closure 80 opposite the protrusion 84. A force is then applied to the opposite end 19 in the downward direction parallel to the axis of the closure. The downward force on end 19 produces an upward force on end 18 due to the lever produced by the length of the device 10 pivoting about the edge of the closure 84 in contact with the inclined portion 44 of the recess. This upward force on the end 20 pries the closure 84 off the container with surprisingly little effort.

It can be appreciated that the inclined portion 44 of the device serves to help position the device onto the closure during the positioning step and then also helps maintain the device on the closure during the prying step. This is because any tendency for the tab 20 of end 18 to slip away from the closure and thereby disengage the protrusion 84 is resisted by the contact between the opposite side of the closure 84 and the inclined portion 44. In an embodiment where the inclined portion 44 is a continuous inclination, such slipping is prevented by that inclination, because any such slipping would require the device 10 to ride upward over the edge of the closure 84 against the downward force applied to the end 19. In an embodiment having a series of steps 46 as shown in FIG. 1, such slipping of the tab 20 away from the closure 80 is resisted by the vertical or inclined portion of the steps. It can be appreciated that, contrary to typical prior art devices, the inclined portion 44, whether of a continuous inclination or a series of steps as shown, allows a single device to be used for a variety of closure sizes.

Also, unlike typical prior art devices, the recess 30 produced by the mounting of the supports 24 and 26 together with the v-shaped tab 20 at the end 18 of the device 10 allow the user to quickly locate the protrusion 84 of the closure 80 and visually ensure that the tab 20 is properly engaged with the protrusion 84. Specifically, the edge 38 of the tab 20 rides against the inclined surface of the protrusion 84. The user thus can quickly accomplish that engagement and maintain it without fumbling the device as he relies solely on the feel between the device and the closure.

It should be appreciated that the hook 50 on the opposite end 19 of the device is convenient for hooking and removing from the container the cotton packing that is often found and just-opened medicine vials. The tip 32 of the tab 20 can be made sufficiently pointed to readily cut and remove the wrapping often found around the closure and neck of the container to deter tampering with the medicine and also to cut an remove the foil seal often found in the interior of the container neck. Finally, the hole 52 allows the device to be conveniently hung on a hook or other protrusion to be placed on a key chain for ready access by the user.

What is claimed is:

1. A device for removing from a container a cap having a top portion and a peripheral skirt, the peripheral skirt having one side with a radially extending protrusion and an opposite side wherein the protrusion of the cap is v-shaped with a first edge extending upwardly and in a first circumferential direction around the cap and a second edge extending upwardly and in a second circumferential direction opposite the first circumferential direction, the device comprising: a body with one end having a notch to receive the protrusion and a free end opposite the notch end and a length therebetween, wherein the notch includes a first wall to engage said first edge and a second wall to engage said second edge the length of the body being such that when the notch receives the protrusion on said one side of the peripheral skirt the free end overhangs the opposite side of the peripheral skirt so that urging the free end toward the container pivots the body to urge the notch end away from the container to pry the cap off the container.

2. The device of claim 1, wherein the top portion is round and the peripheral skirt is cylindrical, and the first wall and second wall each have an arcuate side toward the body length to engage the cylindrical skirt.

3. The device of claim 1, wherein the first wall and second wall are joined at a joint, the first wall extending upwardly and in said first circumferential direction from said joint substantially parallel to said first edge, and the second wall extending upwardly and in said second circumferential direction from said joint substantially parallel to said second edge.

4. The device of claim 3, wherein the first wall and second wall are arranged such that the protrusion is visible when the notch receives the protrusion.

5. The device of claim 4, wherein the first wall and second wall and body define a hole through the device extending parallel to the length of the body, whereby the engagement of the first wall with the first edge and the engagement of the second wall with the second edge are visible through the hole.

6. The device of claim 5, wherein the device has a bottom to engage the cap and a top opposite the bottom, and wherein the notch extends through the top so that the protrusion is visible from the top when the notch receives the protrusion.

7. The device of claim 4, wherein the body includes a recess with a surface parallel to the body length to receive the cap and a top opposite said surface, the surface being bounded toward the notch end by the notch and the surface being bounded on an opposite side by a surface to the cap so that urging the free end toward the container causes the abutting surface to urge the cap toward the recess as the recess end pries the cap off the container.

8. The device of claim 7, wherein the cap abutting surface is sloped generally away from the notch end and away from the top.

9. The device of claim 8, wherein the cap abutting surface includes a plurality of adjacent steps, each step being separated from the adjacent step by an inclined surface.

10. The device of claim 9, wherein the device includes a book.

11. The device of claim 10, wherein the hook is on the free end.

12. The device of claim 9, wherein the free end includes a hole.

13. The device of claim 9, wherein the device end includes a point.

14. The device of claim 13, wherein the point is on the notch end at the joint.

15. A method for removing from a container a cap having a top portion and a peripheral skirt, wherein the peripheral skirt has one side with a radially extending protrusion and an opposite side, the method comprising: placing onto the cap a removal device having a body with a notch in one end sand a free end opposite the notch end, such that the notch receives the protrusion and the body extends across the top portion and the free end overhangs the cap wherein the body includes a recess with a surface to receive the top portion of the cap, the recess having one side toward the notch end and an opposite side toward the free end, the opposite side being sloped generally away from the cap and downward, so that the step of urging the free end toward the container results in the generally sloped surface urging the cap toward the notch; urging the free end toward the container to pivot the body so that the notch end is urged away from the container to pry the cap off the closure; and breaking a seal on the container using a sharp element on the device, wherein the sharp element is on the notch end of the device.

16. A method for removing from a container a cap having a top portion and a peripheral skirt, wherein the peripheral skirt has one side with a radially extending protrusion and an opposite side, the method comprising: placing onto the cap a removal device having a body with a notch in one end and a free end opposite the notch end, such that the notch receives the protrusion and the body extends across the top portoin and the free end overhangs the cap wherein the body includes a recess with a surface to receive the top portion of the cap, the recess having one side toward the notch end and an opposite side toward the free end, the opposite side being sloped generally away from the cap and downward, so that the step of urging the free end toward the container results in the generally sloped surface urging the cap toward the notch; urging the free end toward the container to pivot the body so that the notch end is urged away from the container to pry the cap off the closure; breaking a seal on the container using a sharp element on the device, and removing from the container packing material after removing the cap from the container, using a hook on the device.

* * * * *

UNITED STATES PATENT AND TRADEMARK OFFICE

CERTIFICATE OF CORRECTION

PATENT NO. : 5,313,859

DATED : May 24, 1994

INVENTOR(S) : Gage Garby and Jeffery T. Ballas

It is certified that error appears in the above-indentified patent and that said Letters Patent is hereby corrected as shown below:

Column 3, Line 57, change: "82" to --83--

Column 6, Line 12, change: "sand" to --and--

Signed and Sealed this

Twentieth Day of December, 1994

*Attest:*

Bruce Lehman

BRUCE LEHMAN

*Attesting Officer*

*Commissioner of Patents and Trademarks*